US007009471B2

(12) United States Patent
Elmore

(10) Patent No.: US 7,009,471 B2
(45) Date of Patent: Mar. 7, 2006

(54) METHOD AND APPARATUS FOR LAUNCHING A SURFACEWAVE ONTO A SINGLE CONDUCTOR TRANSMISSION LINE USING A SLOHED FLARED CONE

(75) Inventor: Glenn E. Elmore, Santa Rosa, CA (US)

(73) Assignee: Corridor Systems, Inc., Santa Rosa, CA (US)

( * ) Notice: Subject to any disclaimer, the term of this patent is extended or adjusted under 35 U.S.C. 154(b) by 0 days.

(21) Appl. No.: 10/732,080

(22) Filed: Dec. 9, 2003

(65) Prior Publication Data

US 2004/0169572 A1 Sep. 2, 2004

Related U.S. Application Data

(60) Provisional application No. 60/432,099, filed on Dec. 9, 2002.

(51) Int. Cl.
*H01P 3/10* (2006.01)

(52) U.S. Cl. ..... 333/240; 333/34

(58) Field of Classification Search ..... 333/240, 333/34
See application file for complete search history.

(56) References Cited

U.S. PATENT DOCUMENTS 3,134,951 A * 5/1964 Huber et al. ..... 333/240
6,384,700 B1 * 5/2002 Craine et al. ..... 333/240

* cited by examiner

*Primary Examiner*—Benny Lee
(74) *Attorney, Agent, or Firm*—Larry D. Johnson; Craig M. Stainbrook; Johnson & Stainbrook LLP

(57) ABSTRACT

An apparatus for launching a surfacewave onto a single conductor transmission line provides a launch including a flared, continuously curving cone portion; a coaxial adapter portion; a wire adapter portion for contacting the wire conductor which allows for a multiplicity of wire dimensions for either insulated or uninsulated wire, or a tri-axial wire adapter device enabling non-contacting coupling to a wire; and a longitudinal slot added to the flared cone, wire adapter, and coaxial adapter portions of the launch to allow direct placement of the launch onto existing lines, without requiring cutting or threading of those lines for installation.

29 Claims, 7 Drawing Sheets

METHOD AND APPARATUS FOR LAUNCHING A SURFACEWAVE ONTO A SINGLE CONDUCTOR TRANSMISSION LINE USING A SLOHED FLARED CONE

CROSS REFERENCE TO RELATED APPLICATIONS

The present application claims the benefit of the filing date of U.S. Provisional Patent Application, Ser. No. 60/432,099, filed 09 Dec. 2002.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to methods and apparatus for surfacewave transmission, and more particularly to an improved method and apparatus for launching a surfacewave onto a single wire transmission line.

The present invention improves the performance and utility of previous launch devices for converting coaxial mode transmission to and from surfacewave mode transmission on a single conductor transmission line. This technology is related to transmission lines made from single conductor line having a thick outer dielectric sheath, an insulated wire, and known as a "Gobau line", "G-line", SWTL (surface wave transmission line), or "singlewire", and is also related to lines made using thinly insulated conductors, as well as completely uninsulated conductors having no outer dielectric sheath at all. It includes conductors fabricated from multiple parallel strands, twisted or untwisted, and either insulated from each other or contacting each other, as well as single solid conductors of elliptical or rectangular cross-section.

BACKGROUND INFORMATION AND DISCUSSION OF RELATED ART

Previous launch devices for single conductor transmission lines have used a simple conical shape structure to excite the surfacewave mode onto an insulated single conductor transmission line. In addition to having excess transmission attenuation due to losses in the dielectric insulation, these designs suffer from significant impedance mismatch, unwanted conversion to radiating modes and resultant transmission attenuation of the surfacewave mode when a broad range of frequencies is supported, and require both a longer cone and wider cone mouth in order to excite a surfacewave mode onto the single conductor. Special effort is also required to mount these previous designs onto the conductor, requiring that the transmission line be broken so that the launch may be threaded onto the line in order to be attached. This presents both mechanical and electrical challenges and limitations to the designer and installer of such a device, particularly if the launch apparatus is to be installed onto a pre-existing single conductor line.

The foregoing reflects the current state of the art of which the present inventor is aware. Reference to, and discussion of, this art is intended to aid in discharging Applicant's acknowledged duty of candor in disclosing information that may be relevant to the examination of claims to the present invention. However, it is respectfully submitted that none of the prior art discloses, teaches, suggests, shows, or otherwise renders obvious, either singly or when considered in combination, the invention described and claimed herein.

SUMMARY OF THE INVENTION

The present invention provides a method and apparatus for launching a surfacewave onto a single conductor transmission line. The inventive apparatus provides launch of a surfacewave onto either insulated or uninsulated single conductors making application to a variety of existing lines not only practical, but simpler and more economical. This furthers the use of existing lines, such as high tension power main wires, for surfacewave mode transmission of UHF and microwave energy. Previous known references and teachings on the subject have restricted usage to insulated wires.

The invention includes a flared cone portion constructed of either a continuously curving "horn" or a combination of two or more straight conical sections of different flare angle approximating a curved structure, providing improved impedance match, improved broadband and multiband transmission performance and improved conversion to surfacewave mode with a physically smaller horn section when compared to prior, single conical section designs.

The invention further includes a coaxial adapter portion which adapts conventional coaxial transmission cable to the coaxial transmission line mode which is present at the narrow end of the cone or horn section of the launch, and which can function simultaneously on two different frequency ranges separated by more than an octave.

A first embodiment of the invention provides a wire adapter device for contacting the wire conductor which allows for a multiplicity of wire dimensions for either insulated or uninsulated wire. A second embodiment provides a tri-axial wire adapter device enabling non-contacting coupling to a wire.

The invention also provides a longitudinal slot incorporated into to the flared cone, wire adapter, and coaxial adapter sections of the launch which allows simple and easy placement of the launch onto existing lines, and requires no cutting or threading of those lines for installation. Use of such a slot is not inconsistent with good electrical characteristics of the launch.

It is therefore an object of the present invention to provide a new and improved surfacewave launch apparatus.

It is another object of the present invention to provide a new and improved surfacewave launch adapted for use on insulated or uninsulated single conductors.

A further object or feature of the present invention is a new and improved flared cone apparatus with improved broadband and multiband transmission performance.

An even further object of the present invention is to provide a novel coaxial adapter for conventional coaxial transmission cable.

A still further object of the present invention is to provide an improved wire adapter for contacting a wire conductor.

An additional object of the present invention is to provide an improved method for placement of a surfacewave launch on an existing line.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawing wherein:

FIG. 3A is an end elevation view of the surfacewave launch of FIG. 2, while

FIG. 4A is an end elevation view of a wire adapter of this invention as installed on a single wire conductor, while

FIG. 6A is a perspective view of the flared horn portion of an alternate embodiment of the surfacewave launch of this invention; while

DETAILED DESCRIPTION OF THE INVENTION

Figure 1:
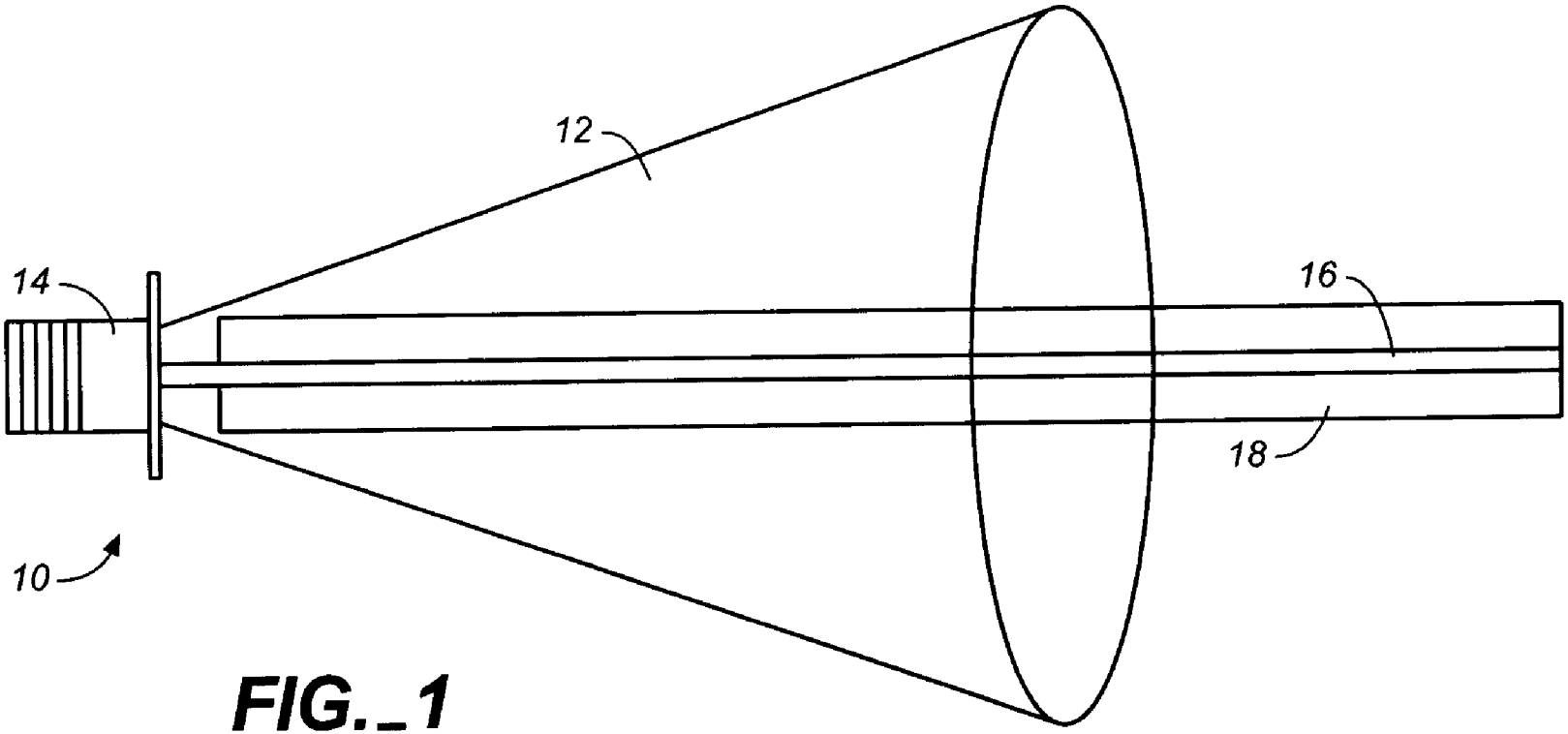
FIG. 1 (PRIOR ART)
FIG. 1 is a schematic view of a prior art surfacewave launch device.

FIG. 1 is a schematic view of a prior art surfacewave launch device 10. Prio art surfacewave launch 10 includes conical launch 12 and coaxial connector 14, both connected to wire conductor 16 covered by an outer dielectric sheath 18. Mounting of the prior art launch device 10 requires that wire 16 be broken, so that the launch may be threaded on. This presents both mechanical and electrical problems to the installer of such a device, particularly if the launch is to be installed onto a pre-existing single conductor line.

Referring to FIGS. 2, 3A, 3B, 4A, 4B, 5, 6A, 6B, 6C, wherein like reference numerals refer to like components in the various views, there is illustrated therein a new and improved surfacewave launch apparatus of this invention.

Figure 2:
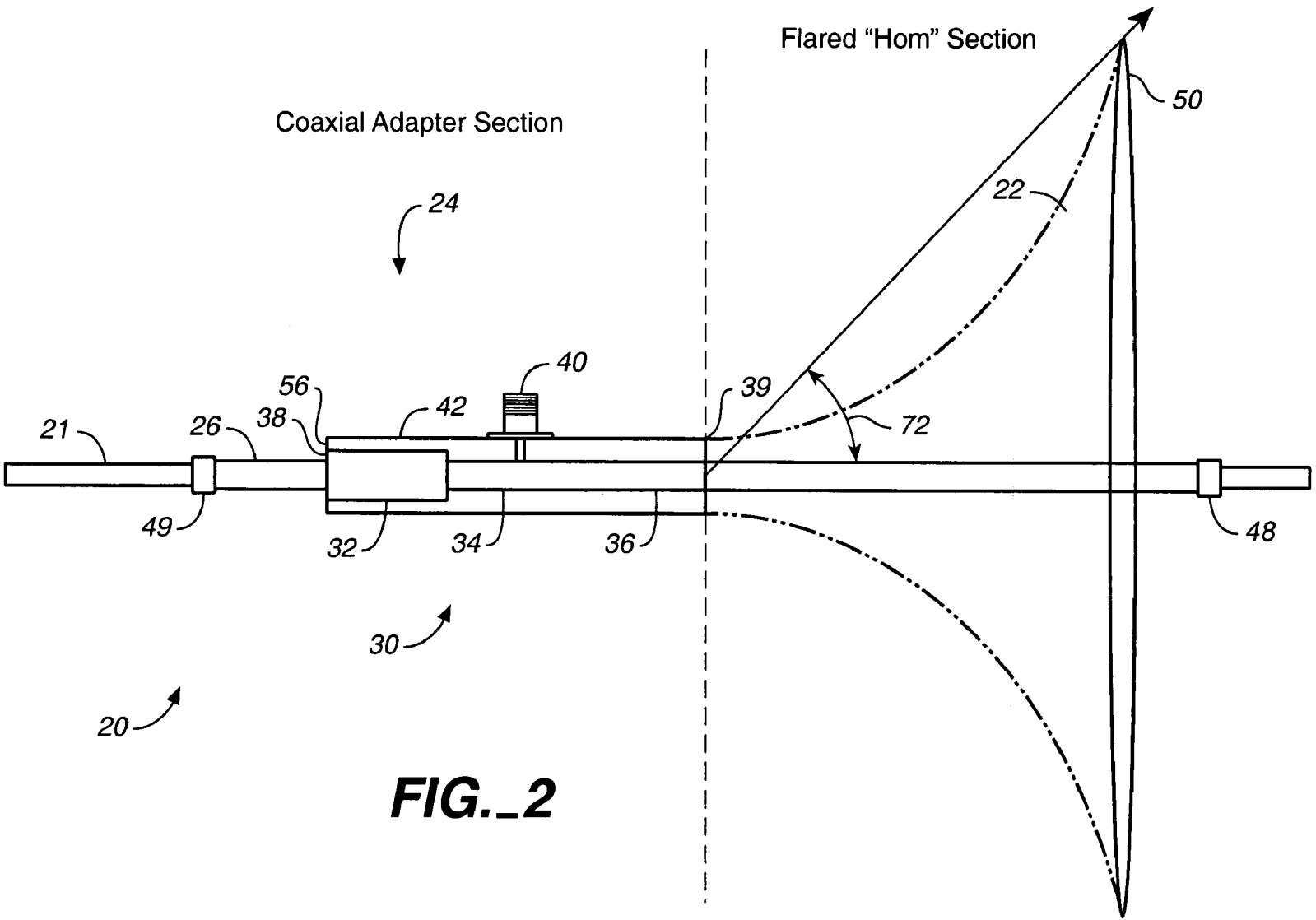
FIG. 2 is a side elevation cross-sectional view of a first embodiment of an improved surfacewave launch apparatus of this invention.

FIG. 2 is a side elevation cross-sectional view of a first embodiment of the improved apparatus 20 for launching a surfacewave onto a single conductor transmission line 21 (either with or without an outer dielectric covering). Surfacewave launch 20 includes a flared horn or cone section 22, a coaxial adapter section 24, and a wire adapter portion 26.

The entire launch device may be cast or formed from a single piece of metal if desired. However, for the purpose of this description, construction of the inventive apparatus will be divided into sections for clarity as follows: (a) the construction of the coaxial adapter; (b) the construction of the flared cone or "horn"; and (c) the construction of the wire adapter. Construction here is described for use with coaxial connections with 50 ohm characteristic impedance, but other designs are possible by modifying the dimensions. Similarly, this description shows a launch apparatus designed to operate simultaneously on two US ISM bands centered around 2.44 GHz. and 5.3 GHz. Other choices are possible by changing the dimensions of the multiband choke sections and the size of the open end of the flared cone, as is well known in the art.

In the first embodiment of the improved surfacewave launch apparatus of this invention, as depicted in FIGS. 2, 3A, 3B, 4A, 4B, construction of the coaxial adapter portion 24 consists of the multiband choke sections 30, comprised of a 19 ohm section 32, a 50 ohm section 34, and another 50 ohm extension section 36, along with a shorting end 38 (opposite non-shorted end 39) and a mounted coaxial connector 40. The coaxial connector 40 is mounted with its outer (ground) connection attached to the outer sleeve 42 which is provided with a hole for the connecter pin 44 (FIG. 3B) or inner conductor to pass through. The pin extends into the inside of the sleeve 42 and makes low impedance electrical contact with the wire adapter 26. The flared horn 22, wire adapter 26, and coaxial adapter 24 each include a longitudinal slot 23 (FIG. 3A), 46, and 47 (FIG. 3B), respectively, provided for mounting onto the single conductor line without breaking the line.

The wire adapter 26 shown here makes electrical contact with the single wire conductor 21 at downstream terminus 48 beyond the mouth 50, the widest dimension of the flare on the flared cone 22, effectively providing an electromechanical attachment to the wire at that point. The other wire adapter terminus 49 is preferably only a mechanical attachment.

Figure 4B:
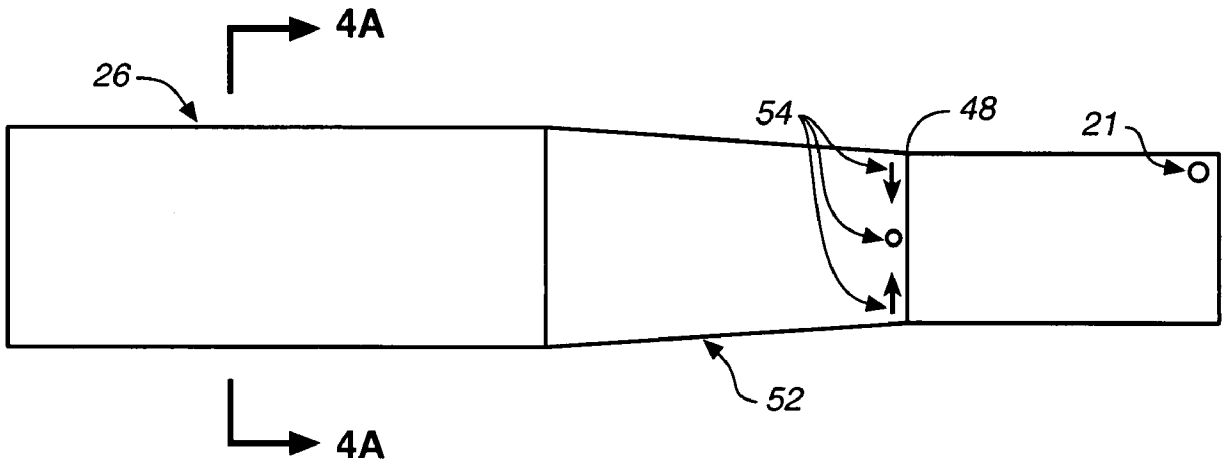
FIG. 4B is a top view of a wire adapter as installed on a single wire conductor, showing the taper to the single wire conductor.
Figure 4A:
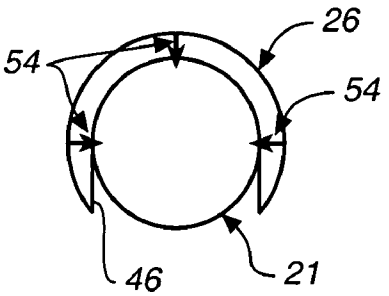

FIGS. 4A and 4B illustrate the wire adapter 26 as installed on a single wire conductor 21. This connection is required to provide a low impedance between the wire adapter and the single conductor wire across both operating bands of the launch. It is desirable for the wire adapter 26 to be as thin as is mechanically practical since its dimensions decrease the impedance at the mouth of the flared cone. Additionally, there is an impedance discontinuity at the terminus 48 (FIG. 4B) of the wire adapter 26 which is minimized when the step in diameter between the wire adapter and the wire is small. Tapering the end of the wire adapter, as along tapered section 52 (FIG. 4B), helps minimize this discontinuity. The length of the taper is preferably at least a quarter wave at the lowest operating frequency.

Direct electrical contact between the terminus 48 of the wire adapter and the wire 21 is provided by metal contacts such as "tacks" 54 which are driven through the wire adapter 26, through any dielectic which is present, and into the wire conductor. These tacks may be further secured with a dielectric compression band of the "TyWrap" (cable tie) variety.

Good electrical contact is also required among the end short 38, the end 56 (FIG. 2) of the outer sleeve 42 and the wire adapter 26.

Figure 5:
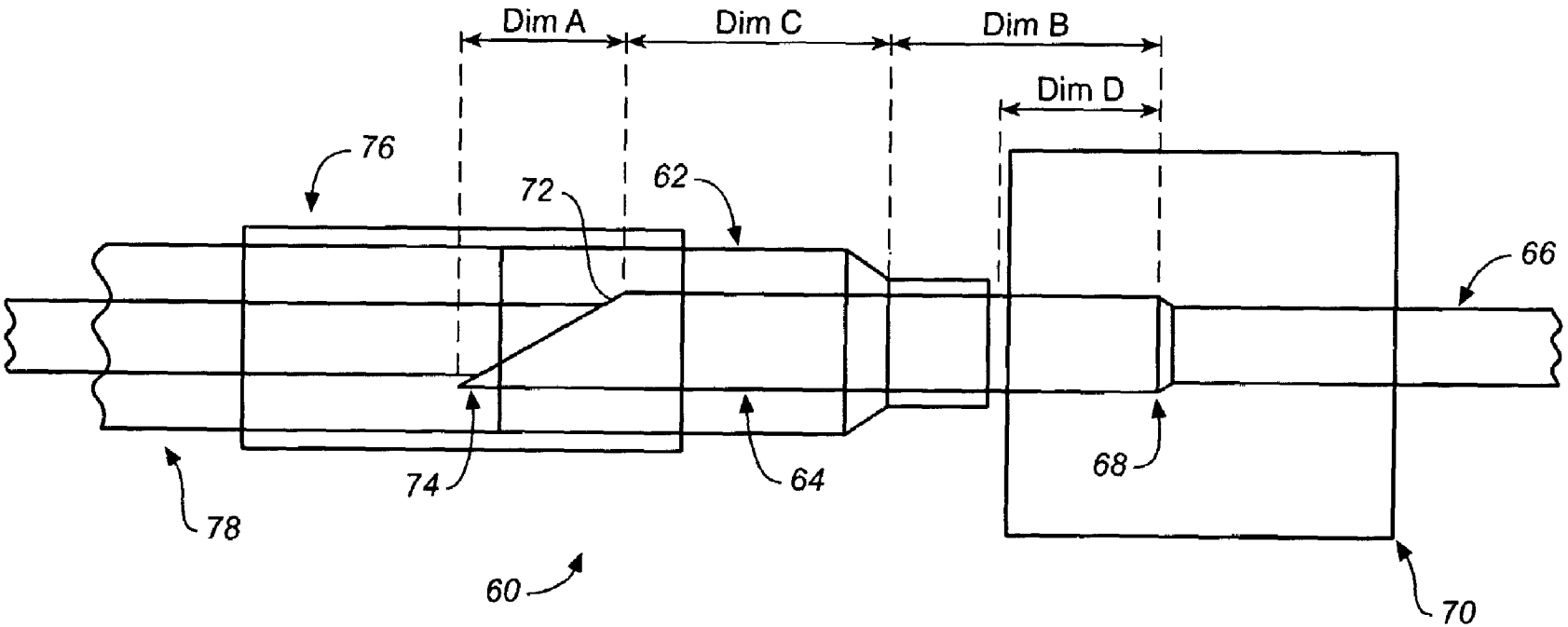
FIG. 5 is a side elevation cross-sectional view of an alternate dualband embodiment for a coaxial adapter of this invention.

FIG. 5 is a side elevation cross-sectional view of an alternate dualband embodiment for a coaxial adapter 60 of this invention. This embodiment utilizes a triaxial structure providing a bushing/triax outer conductor 62, a triax intermediate conductor 64, and using the single conductor/triax center line 66 as the third and central conductor of the assembly. This method allows coupling to and launching of the surfacewave mode onto the central line but requires only a single electrical and mechanical contact onto that line, i.e., shorting point 68 located at the end, shorting block 70. Two separate coaxial cavities are formed, one between the intermediate line 64 and the central line 66, and a second between the outer conductor 62 and the intermediate line 64. The intermediate line 64 is tapered at the open end 72 where the coaxial cable contact is made at connection 74. Coupling 76 couples the adapter section to the narrow end 78 of the flared horn. The two coaxial cavities, along with the tapered line provide good coupling to the central line across two separate bands without requiring any physical contact which could be problematic for outdoor use due to environmental concerns.

For the construction of the flared cone section in both embodiments, the cone or "horn" section may be cast or formed from either metal or from a non-conducting material and metalized after fabrication. As for the coaxial adapter section, for lowest losses copper or silver should be plated onto the current carrying surfaces or used directly for the entire interior of the flared cone section.

While the flared cone may be fabricated from multiple flat sheet metal subsections to approximate the desired exponential tapered shape, the preferred method of construction is to create a three-dimensional curved surface which exactly represents the desired exponential taper. This taper is such that the resulting impedance of the coaxial line formed by the flared cone outer conductor and the wire adapter inner conductor ranges from the coaxial adapter extension section impedance (50 ohms) to a higher impedance which is that of a coaxial line having an outer conductor inner dimension the same as the mouth of the flared cone, and an inner conductor of the same dimensions as the wireless adapter.

Figure 3B:
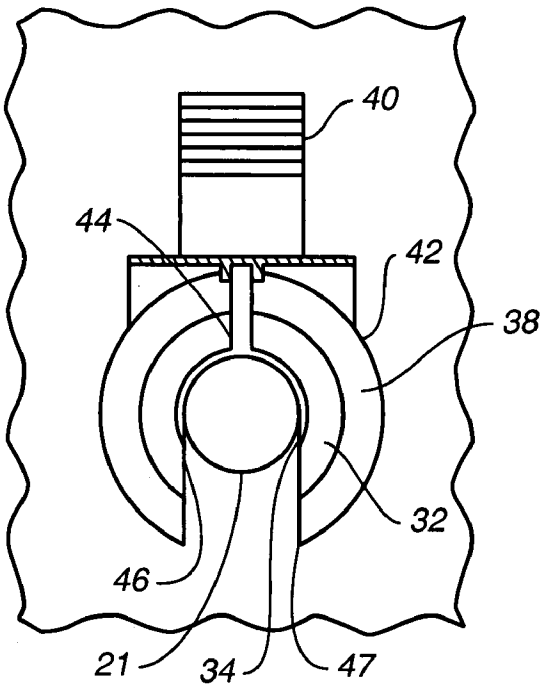
FIG. 3B is an enlarged end elevation view of the coaxial adapter and wire adapter portions of the surfacewave launch of FIG. 3A.
Figure 3A:
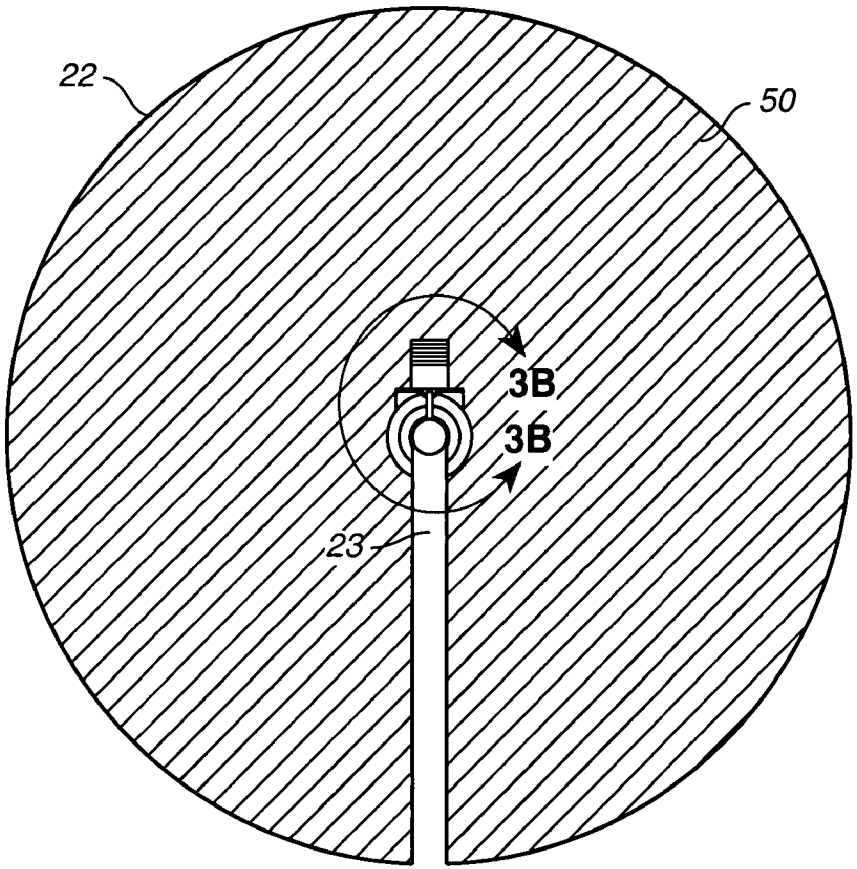

In the first embodiment of FIGS. 2, 3A, 3B, the flared cone diameter is exponentially tapered between these two end limits, as shown. The flare angle 72 of the flared cone 22 (FIG. 2), measured from the non-shorted end 39 (FIG. 2) of the coaxial adapter portion 24 to the center of the opening, is preferably between 40 and 60 degrees.

Figure 6A:
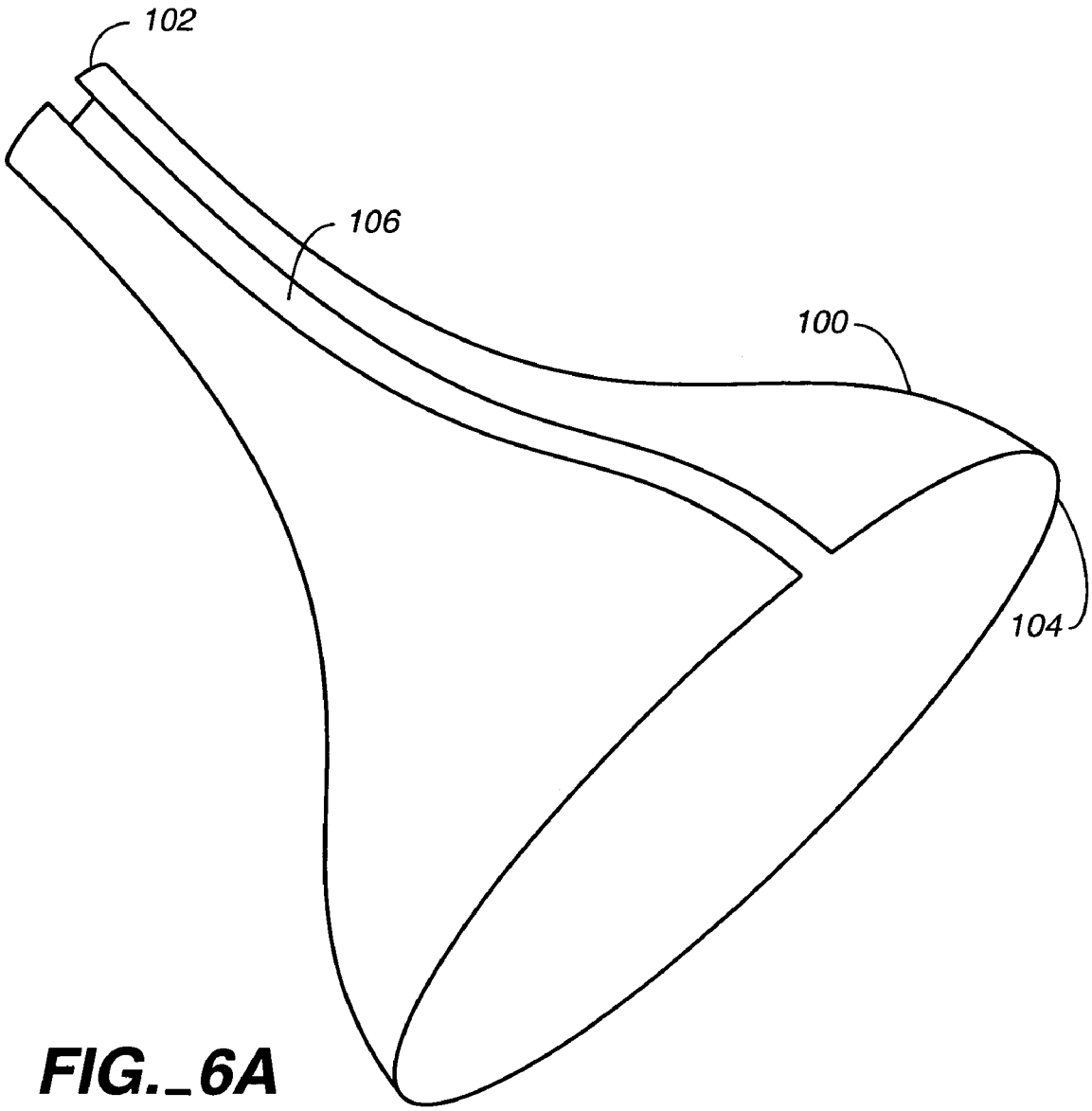
Figure 6C:
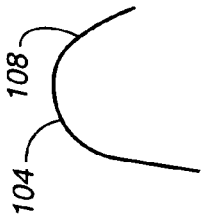
FIG. 6C is a detail view of an optional rolled edge for the outer mouth of the flared horn.
Figure 6B:
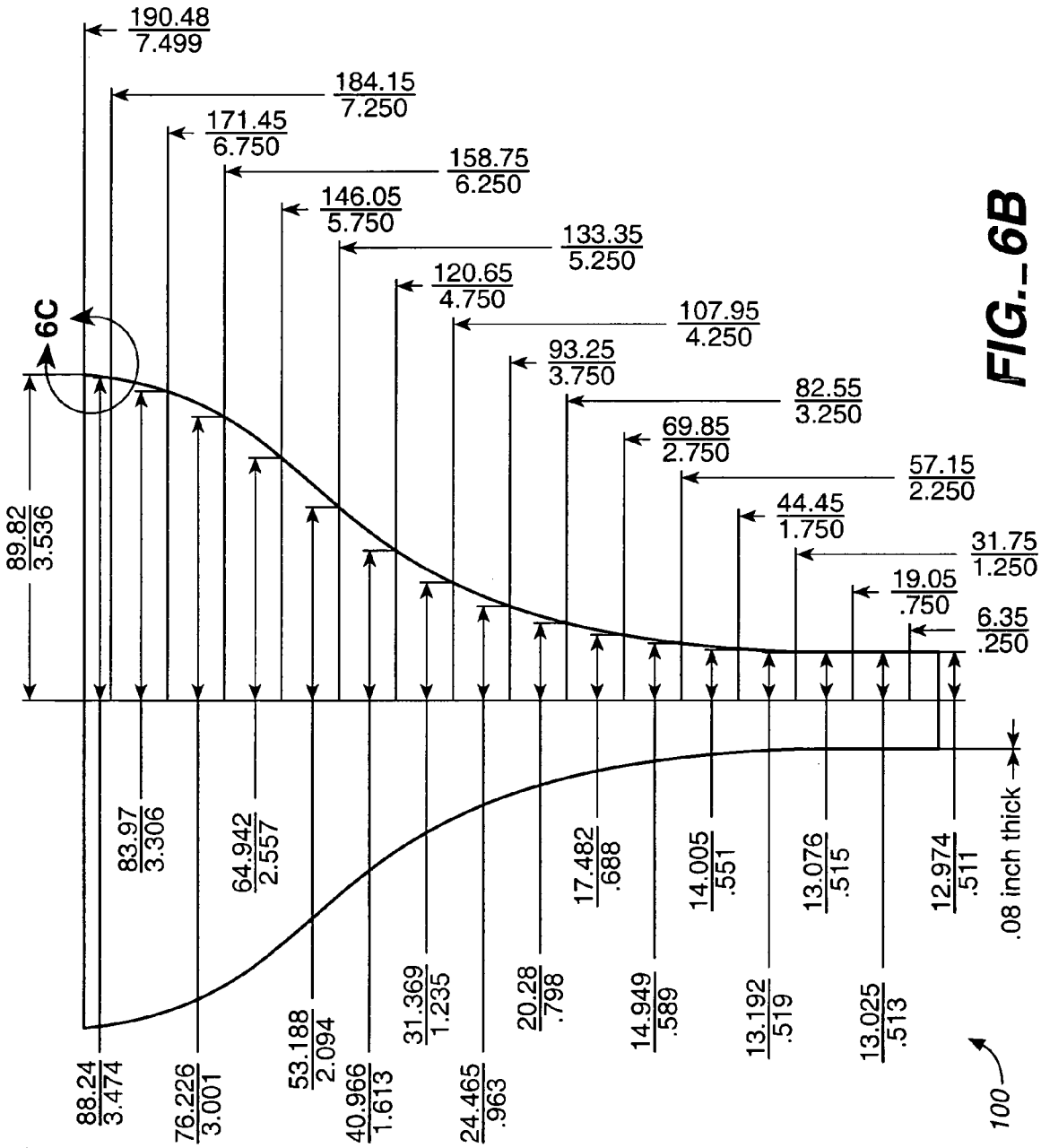
FIG. 6B is a cross-sectional view of the flared horn of FIG. 6A.

In the second embodiment illustrated in FIGS. 6A, 6B, 6C, the diameter throughout the midsection of the flared cone 100 is substantially exponentially tapered while the change of taper at the ends (narrow end 102 and mouth 104 ) falls to zero. This arrangement can improve the broadband characteristics of the launch. To arrive at particular dimensions, it is useful to consider the entire cone from the perspective of a broadband coaxial line matching transformer. As with the first embodiment of FIGS. 2, 3A, 3B, the higher impedance at the mouth 104 of the flared cone 100 should be as high as possible, and preferably over 200 ohms. FIG. 6B shows the dimensions of this second embodiment. The values on the left indicate the horn's inside radius, and the values on the right are the location of that radius, relative to the reference point which is at the intersection of the vertical line of symmetry and the narrow end 102 of the horn. Thus, these numbers are actually coordinate pairs showing the radius of the horn as you go alone it's length, increasing toward the wide, mouth end 104 of the horn. Also analogous to the flared cone of the first embodiment, the cone 100 includes a longitudinal slot 106 (FIG. 6A) enabling direct mounting onto a wire.

As detailed in FIG. 6C, the edge 108 of the outer mouth 104 of the flared horn may be rolled smoothly rather than simply terminating. This can be advantageous for reducing surfacewave to radiated mode conversion and improving transmission characteristics of the surfacewave mode.

Construction of the wire adapter and end short is also different for the two embodiments. In the first embodiment of FIGS. 2, 3A, 3B, 4A, 4B, the wire adapter 26 serves to allow a variety of wire shapes and sizes to be used with the launch.

For the case where circular wire is being adapted, the wire adapter 26 may have a circular internal shape, exclusive of the longitudinal slot 46, in which the circular single wire lays (see FIGS. 3B and 4A). For this case, the wire adapter 26 may be constructed by cutting copper tubing lengthwise with a band saw. The end short 38 may be constructed from a copper disk, slightly larger than the outer diameter of the outer sleeve 42, and providing a hole of the same diameter as the wire adapter outer diameter (see FIGS. 2 and 3B).

In the second embodiment (FIG. 5), no physical contact is required, so it is possible to accommodate multiple wire diameters by simply providing different hole diameters in the end, shorting block 68. The electrical design of the dual coaxial cavity structure is tolerant of considerable variation in line size without a great deal of sacrifice in performance. For radically different central wire diameters, it may be necessary to modify the dimensions of the coaxial cavities as well as the flared horn.

Assembly of the launch also differs with the two embodiments. For the first embodiment (FIGS. 2, 3A, 3B, 4A, 4B), a hole the diameter of the coaxial connecter pin 44 is provided in the wire adapter 26.

Depending upon requirements, mechanical strength and hermeticity may be improved by filling the flared cone 22 and coaxial adapter 24 with a low loss, low dielectric constant material. However, if this is done, dimensions may have to be modified to achieve the desired impedances.

For the first embodiment of the launch, as shown in FIGS. 2, 3A, 3B, 4A, 4B, dimensions and materials may be as follows:

| | |
|---|---|
| Flared Horn Length | 3.5 inch |
| Flared Horn Mouth Diameter | 3.5 inch |
| Outer Sleeve Inner Diameter | .60 inch |
| Wire Adapter Outer Diameter | .26 inch |
| Wire Adapter Length | 8.0 inch |
| Single Wire Diameter | .23 inch |
| 19 ohm section Diameter | .44 inch |
| 19 ohm section length | .91 inch |
| 50 ohm section Diameter | .26 inch |
| 50 ohm section length | .61 inch |
| 50 ohm extension length | 1.4 inch |
| Coaxial Connector | type SMA or N |

All material except for the connector is copper.

For the second embodiment of the launch, as shown in FIGS. 5, 6A, 6B, 6C, dimensions and materials may be as follows:

| | |
|---|---|
| Flared Horn Length | 3.5 inch |
| Flared Horn Mouth Diameter | 7 inch |
| Coupling | 1" US Schedule L copper coupling |
| Bushing | 1" to ½" US Schedule L copper bushing |
| Triax Intermediate Conductor | ½" US Schedule L copper pipe |
| End, Shorting Block | Aluminum |
| Central Wire Diameter | .25 to .32 inch |
| Coaxial Connector | type SMA or N |
| Dimension A (length of tapered portion of intermediate conductor) | 1.78 inch |
| Dimension B (length by which central coaxial cavity is greater than outer coaxial cavity) | 1.40 inch |
| Dimension C (length of constant impedance portion of central coaxial cavity that is common with outer coaxial cavity) | .85 inch |
| Dimension D (length of central coaxial cavity clamped by shorting block) | .75 inch |

The completed surfacewave launch may be mounted to an existing single wire conductor as follows. For the first embodiment, illustrated in FIGS. 2, 3A, 3B, 4A, 4B, the wire adapter attachment devices (metal contacting tacks 54) are first installed to establish good electrical contact and mechanical robustness.

After mounting the device the singlewire transmission line may be used over the entire frequency and band ranges supported just as other types of transmission lines fitted with coaxial connectors would be. Transmitters, receivers, filters and frequency selective devices may be added external to the device and connected to the coaxial connector to suit the desired application. Although shown in the figures as a coaxial cable connector, this connector may also be for direct connection to electronic circuitry located immediately adjacent to the coaxial section of the inventive launch, thus allowing the launch to be part of an integrated communications assembly.

Accordingly, the present invention may be characterized as a launch apparatus for launching a surfacewave onto a single conductor transmission line, the launch apparatus comprising a flared cone portion; a coaxial adapter portion connected to the flared cone portion; a wire adapter portion for coupling the coaxial adapter portion to the line; and a longitudinal slot in the flared cone portion, coaxial adapter portion, and wire adapter portion to enable direct placement of the launch apparatus onto the line for installation.

Alternatively, the invention may be characterized as a method for launching a surfacewave onto a single conductor transmission line, the method comprising the steps of providing a launch apparatus having a flared cone portion, a coaxial adapter portion connected to the flared cone portion, and a wire adapter portion for coupling the coaxial adapter portion to the line; providing a longitudinal slot in the flared cone portion, coaxial adapter portion, and wire adapter portion; and placing the launch apparatus over the line for installation.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A launch apparatus for launching a surfacewave onto a single conductor transmission line, said launch apparatus comprising:

a flared cone portion;

a coaxial adapter portion connected to said flared cone portion;

a wire adapter portion for coupling said coaxial adapter portion to the line; and a longitudinal slot in said flared cone portion, said coaxial adapter portion, and said wire adapter portion to enable direct placement of said launch apparatus onto the transmission line for installation.

2. The launch apparatus of claim 1 wherein said flared cone portion comprises a continuously curving horn.

3. The launch apparatus of claim 1 wherein said flared cone portion comprises a three-dimensional curved surface.

4. The launch apparatus of claim 1 wherein said flared cone portion includes a pair of ends, and said flared cone portion is exponentially tapered between said pair of ends.

5. The launch apparatus of claim 4 wherein said pair of ends are not tapered.

6. The launch apparatus of claim 1 wherein said flared cone portion has a flare angle of between 40 and 60 degrees.

7. The launch apparatus of claim 1 wherein said coaxial adapter portion includes a multiband choke section.

8. The launch apparatus of claim 1 wherein said coaxial adapter portion includes a mounted coaxial connector bearing a pin to make low impedance electrical contact with said wire adapter portion.

9. The launch apparatus of claim 1 wherein said coaxial adapter portion includes a triaxial structure providing an outer conductor, an intermediate conductor, and a central conductor.

10. The launch apparatus of claim 9 wherein said coaxial adapter portion central conductor comprises the transmission line.

11. The launch apparatus of claim 1 wherein said coaxial adapter portion includes a single electrical and mechanical contact onto the transmission line.

12. The launch apparatus of claim 11 wherein said single electrical and mechanical contact comprises a shorting block.

13. The launch apparatus of claim 12 wherein said shorting block includes a bore sized to fit the transmission line, and is mounted around the transmission line.

14. The launch apparatus of claim 1 wherein said coaxial adapter portion includes two separate coaxial cavities.

15. The launch apparatus of claim 1 wherein said wire adapter portion includes a tapered section to minimize discontinuity with the transmission line.

16. The launch apparatus of claim 1 wherein said wire adapter portion includes metal contacts with the transmission line.

17. The launch apparatus of claim 1 wherein said flared cone portion is constructed of metal.

18. The launch apparatus of claim 1 wherein said coaxial adapter position is constructed of metal.

19. The launch apparatus of claim 1 wherein said wire adapter portion is constructed of metal.

20. A method for launching a surfacewave onto a single conductor transmission line, said method comprising the steps of:

providing a launch apparatus having a flared cone portion, a coaxial adapter portion connected to said flared cone portion, and a wire adapter portion for coupling said coaxial adapter portion to the line;

providing a longitudinal slot in said flared cone portion, said coaxial adapter portion, and said wire adapter portion; and placing said launch apparatus over the transmission line for installation.

21. The method for launching a surfacewave onto a single conductor transmission line of claim 20 further including the step of providing an electrical and mechanical contact onto the transmission line.

22. The method for launching a surfacewave onto a single conductor transmission line of claim 21 wherein said step of providing an electrical and mechanical contact onto the transmission line comprises providing metal contacts with the line.

23. The method for launching a surfacewave onto a single conductor transmission line of claim 21 wherein said step of providing an electrical and mechanical contact onto the transmission line comprises providing a shorting block around the line.

24. The method for launching a surfacewave onto a single conductor transmission line of claim 21 wherein said step of providing a launch apparatus includes the step of tapering the wire adapter to reduce impedance and minimize discontinuity with the wire.

25. The method for launching a surfacewave onto a single conductor transmission line of claim 20 wherein said step of providing a launch apparatus includes the step of providing a coaxial adapter having a triaxial structure.

26. The method for launching a surfacewave onto a single conductor transmission line of claim 25 wherein said step of providing a coaxial adapter having a triaxial structure includes forming two separate coaxial cavities.

27. The method for launching a surfacewave onto a single conductor transmission line of claim 26 wherein said step of providing a coaxial adapter having a triaxial structure includes tapering the adapter where contact is made with the line.

28. The method for launching a surfacewave onto a single conductor transmission line of claim 20 wherein said step of providing a flared cone comprises constructing a cone from metal.

29. The method for launching a surfacewave onto a single conductor transmission line of claim 20 wherein said step of providing a flared cone comprises constructing a cone from metalized non-conducting material.

* * * * *